United States Patent [19]

Oudet

[11] 4,337,449

[45] Jun. 29, 1982

[54] MAGNETIC TRANSDUCER WITH A MOVABLE MAGNET

[75] Inventor: Claude Oudet, Besancon, France

[73] Assignee: Portescap, La Chaux-de-Fonds, Switzerland

[21] Appl. No.: 162,484

[22] Filed: Jun. 24, 1980

[51] Int. Cl.[3] ..... H01F 7/08

[52] U.S. Cl. ..... 335/225; 335/298; 336/176

[58] Field of Search ..... 335/225, 298, 297, 282, 335/281, 272, 237, 236, 220, 209; 336/176

[56] References Cited

U.S. PATENT DOCUMENTS 2,555,791 6/1951 Everett ..... 335/281
2,811,680 10/1957 Stoecklin et al. ..... 335/225
2,872,626 2/1959 Paddison ..... 335/225
3,725,832 4/1973 Schweitzer ..... 336/176

*Primary Examiner*—Harold Broome
*Attorney, Agent, or Firm*—Cushman, Darby & Cushman

[57] ABSTRACT

A movable magnet 1 turns in the air-gap formed by pole pieces 3', 4' of a stationary magnetic circuit 2. The magnetic circuit 2 is formed as one piece, and has a deformable connection portion 6, the magnetic properties of which are greatly inferior to those of the remainder of the circuit which enables the branches to move apart for introduction of the coil during assembly. This arrangement facilitates manufacture, while not limiting the diameter of the coil to the dimensions of the air-gap and maintaining a high degree of precision of the air-gap.

1 Claim, 2 Drawing Figures

MAGNETIC TRANSDUCER WITH A MOVABLE MAGNET

The present invention relates to a transducer with a movable magnet comprising at least one electric coil and a one piece stationary magnetic circuit having a high magnetic permeability and formed of two branches, at least one of which serves as the core of the said coil, the two branches at one end comprising pole pieces defining an air-gap, the movable magnet being disposed so that its magnetic potential is arranged in series with that produced by the stationary magnetic circuit.

In a transducer of this kind, in which the stationary magnetic circuit is formed as one piece, the electric coil(s) had to be inserted via the sole opening of the circuit, i.e. via the air-gap. In circuit configurations not allowing the coil to pass via the air-gap, the circuit inevitably had to be constructed in two parts, which leads to well-known drawbacks in the manufacture of these transducers, particularly the necessity of adjusting the air-gap, the problems connected with the tolerances of the parts to be joined, the problems of magnetic joining, etc. . .

In cases in which the coil is inserted via the air-gap of the circuit, its external dimension is restricted by the dimension of the air-gap. The electric power P to be applied to the coil so as to obtain n.i ampere turns is provided by the ratio $ni=\sqrt{P/R_O}$, where $R_O$ is a coefficient associated solely with the geometry of the coil, namely $R_O=R/n^2$, R being the ohmic resistance of the coil. If $R_O$ is limited by the air-gap, the power P necessary for the same n.i will be higher. It is therefore desirable to avoid this limitation of the dimension of the coil.

The object of the invention is to provide a transducer of the type referred to above, in which the coil(s) may be mounted on the magnetic circuit without having to be inserted via the air-gap of the circuit.

According to the present invention, there is provided a transducer with a movable magnet, comprising at least one electric coil and a one piece stationary magnetic circuit having a high magnetic permeability and formed of two branches, at least one of which serves as the core of the said coil, the two branches at one end comprising pole pieces defining an air-gap, the movable magnet being disposed so that its magnetic potential is arranged in series with that produced by the stationary magnetic circuit, wherein the said two branches are connected together in the vicinity of the pole pieces by a deformable saturable connection portion of which the cross-section is substantially smaller than the cross-section of the said branches so as to be saturated by the magnetic flux in the circuit during use, at least one of the two branches comprising, at its end remote from the pole pieces, a main connecting portion designed to form a junction of a low magnetic resistance with the other branch, the arrangement of the stationary magnetic circuit being such that it may adopt a first configuration in which the coil may be positioned in the branch serving as the core and that it may subsequently be deformed to close the said junction so as to obtain the operational configuration of the magnetic circuit.

The invention will now be described further, by way of example, with reference to the accompanying drawings, in which.

Figure 1:
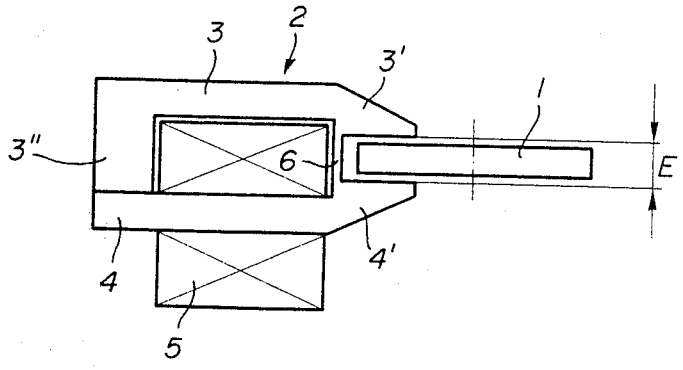
FIG. 1 is a side view of a transducer provided with a rotary magnet.

The transducer shown in FIG. 1 may, for example form a micromotor, in which the movable magnet 1 represents the rotor and stationary magnetic circuit 2 represents a stator element.

The circuit 2 of FIG. 1, preferably constructed of a material having a high magnetic permeability, such as Fe-Ni alloy, comprises two branches 3, 4, which are disposed in parallel and terminate at one end with pole pieces 3', 4'. The branch 4 is provided with a practically uniform section between the pole pieces and its other end. The branch 3 is provided at its end opposite the pole piece with a bent-over part 3'' or main connecting portion, which forms a high-quality magnetic junction upon contact with the branch 4. For this purpose, the section of the part 3'' is preferably enlarged with respect to that of the two branches and the edges 3'' and 4 are either joined together by welding or maintained in contact by an external part, which is not shown, such as the housing of the transducer.

If the circuit 2 were formed as one piece having the same shape as the above-mentioned parts, the coil 5 could be wound onto the branch 4, passing through the air-gap between 3' and 3'. However, in this case its thickness would be limited to that of the air-gap E. Another solution would be to construct the circuit 2 in two separate parts.

Figure 2:
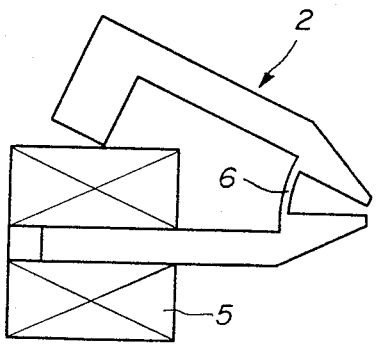
FIG. 2 is a side view of the transducer of FIG. 1 showing the magnetic circuit configuration during assembly of the coil.

On the other hand, the invention enables the circuit to be kept in one piece, without limiting the thickness of the coil to that of the air-gap. For this purpose, a connecting portion 6 having a small cross-section connections the two branches of the circuit at the pole pieces. This connecting portion, which is easily deformable by bending but which precisely determines the dimensions of the air-gap, enables the configuration of the circuit 2 to be such as shown in FIG. 2 for the assembly of the coil, the thickness of which thus becomes independent of the air-gap. The circuit may be given the configuration according to FIG. 2 at the time of manufacture or by deformation when the coil is assembled. The circuit is then deformed and the magnetic joint 3''-4 closed so as to obtain the configuration according to FIG. 1.

The cross-section of the portion 6 is such that the latter will be saturated by the magnetic flux during operation. Consequently, only a very small part of this flux will be short-circuited by this part 6. Furthermore, owing to the deformation which is produced when the circuit is assembled, the magnetic properties of this part are greatly inferior to those of the remainder of the circuit, which is generally annealed. However, the precision of the air-gap is hardly affected by the deformation.

Different embodiments and variants of the invention may easily be constructed. When the coil does not surround the corresponding branch of the magnetic circuit but has a larger internal diameter the magnetic junction may thus be placed in an intermediate section of the main connecting portion connecting the two branches. Furthermore, the saturable connecting portion may be situated at either end of the polar piece, according to the required form of the air-gap.

I claim:

1. A magnetic transducer with a movable magnet, comprising at least one electric coil and a one piece stationary magnetic circuit having a high magnetic permeability and formed of two branches, at least one of which serves as the core of the said coil, the two branches at one end comprising pole pieces defining an air-gap, the movable magnet being disposed so that its magnetic potential is arranged in series with that produced by the stationary magnetic circuit, wherein the said two branches are connected together in the vicinity of the pole pieces by a deformable saturable connecting portion of which the cross-section is substantially smaller than the cross-section of the said branches so as to be saturated by the magnetic flux in the circuit during use, at least one of the two branches comprising, at its end remote from the pole pieces, a main connecting portion designed to form a junction of a low magnetic resistance with the other branch, the arrangement of the stationary magnetic circuit being such that it may adopt a first configuration in which the coil may be positioned on the branch serving as the core and that it may subsequently be deformed to close the said junction so as to obtain the operational configuration of the magnetic circuit.

* * * * *

UNITED STATES PATENT AND TRADEMARK OFFICE

CERTIFICATE OF CORRECTION

PATENT NO. : 4,337,449

DATED : June 29, 1982

INVENTOR(S) : Claude OUDET

It is certified that error appears in the above—identified patent and that said Letters Patent is hereby corrected as shown below:

On the Title Page

Please add to Item [30] the following omitted Foreign Application Priority Data:

June 25, 1979 Switzerland .....5910

Signed and Sealed this

*Fourteenth* Day of *December 1982*

[SEAL]

*Attest:*

GERALD J. MOSSINGHOFF

*Attesting Officer*

*Commissioner of Patents and Trademarks*